US006532777B2

(12) United States Patent
Haeck et al.

(10) Patent No.: US 6,532,777 B2
(45) **Date of Patent: *Mar. 18, 2003**

(54) PANIC EXIT DEVICE MOUNTING PLATE

(75) Inventors: Paul Haeck, Carmel, IN (US); Greg Drake, New Braunfels, TX (US); Albert E. Ranzau, III, Leon Valley, TX (US)

(73) Assignee: Detex Corporation, New Braunfels, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/766,867

(22) Filed: Jan. 19, 2001

(65) Prior Publication Data

US 2001/0005996 A1 Jul. 5, 2001

Related U.S. Application Data

(60) Continuation of application No. 09/434,533, filed on Nov. 5, 1999, now Pat. No. 6,205,825, which is a division of application No. 09/056,261, filed on Apr. 7, 1998, now Pat. No. 6,009,732.

(51) Int. Cl.[7] ..... E05B 65/10

(52) U.S. Cl. ..... 70/92; 70/451; 292/92; 292/DIG. 65

(58) Field of Search ..... 70/92, 450, 451, 70/466; 292/92, 336.3, 340, DIG. 53, DIG. 64, DIG. 65

(56) References Cited

U.S. PATENT DOCUMENTS

| | | | |
|---|---|---|---|
| 2,621,088 | A | 12/1952 | Cole |
| 3,614,145 | A | 10/1971 | Zawadzki |
| 3,663,047 | A | 5/1972 | Zawadski |
| 3,730,574 | A | 5/1973 | Zawadski |
| 3,854,763 | A | 12/1974 | Zawadski et al. |
| 3,940,886 | A | 3/1976 | Ellingson, Jr. |
| 4,083,590 | A | 4/1978 | Folger |
| 4,130,306 | A | 12/1978 | Brkic |
| 4,167,280 | A | 9/1979 | Godec et al. |
| 4,437,693 | A | 3/1984 | Godec |
| 4,624,490 | A | 11/1986 | Miller |
| 4,709,950 | A | 12/1987 | Zortman |
| 4,741,563 | A | 5/1988 | Cohrs |
| 4,801,163 | A | 1/1989 | Miller |
| 4,819,976 | A | 4/1989 | Bert |
| 4,824,150 | A | 4/1989 | Smith et al. |
| 4,865,367 | A | 9/1989 | Choi |
| 4,946,207 | A | 8/1990 | Gillham |
| 4,961,330 | A | 10/1990 | Evans |
| 4,968,070 | A | 11/1990 | Choi |
| 4,974,890 | A | 12/1990 | Cohrs |
| 4,976,476 | A | 12/1990 | Cross et al. |
| 4,978,151 | A | 12/1990 | Coleman et al. |
| 5,011,199 | A | 4/1991 | Lowe et al. |

(List continued on next page.)

OTHER PUBLICATIONS

Detex Corporation, ECL–230D Panic Hardware Device (Short Bar), DWG 0962; Aug. 13, 1991.

Detex Corporation, Installation Instructions for the ECL–230D/230D–PH Exit Control Lock, Detex INS230D pp. 1, 2 and 3; Mar. 30, 2001.

*Primary Examiner*—Suzanne Dino Barrett
(74) *Attorney, Agent, or Firm*—John G. Fischer, Esq.; Storm & Hemingway LLP

(57) ABSTRACT

The panic exit device includes several features which improve its ease of use and operability over earlier devices including: (1) an improved latch deadlocking mechanism; (2) an improved latch to pad mechanism; (3) a pad lock down feature; (4) an improved universal mounting plate and easily mounted strike; and (5) a vertical rod-bottom bolt deadlocking mechanism in its center case. The latch deadlocking mechanism includes a deadlock link, which in the event of a fire, will block the movement of the latch bolt.

25 Claims, 17 Drawing Sheets

U.S. PATENT DOCUMENTS

| | | | | | |
|---|---|---|---|---|---|
| 5,024,070 | A | | 6/1991 | Toledo | |
| 5,031,945 | A | * | 7/1991 | Toledo | 292/336.3 |
| 5,042,851 | A | | 8/1991 | Hunt | |
| 5,067,757 | A | | 11/1991 | Cohrs et al. | |
| 5,085,475 | A | | 2/1992 | Austin et al. | |
| 5,169,185 | A | | 12/1992 | Slaybaugh et al. | |
| 5,219,385 | A | | 6/1993 | Yeh | |
| 5,340,171 | A | | 8/1994 | Slaybaugh et al. | |
| 5,412,961 | A | | 5/1995 | Cain et al. | |
| 5,464,259 | A | | 11/1995 | Cohrs et al. | |
| 5,517,176 | A | | 5/1996 | Lavelle et al. | |
| 5,527,074 | A | | 6/1996 | Yeh | |
| 5,605,362 | A | | 2/1997 | Surko, Jr. | |
| 5,816,017 | A | | 10/1998 | Hunt et al. | |
| 5,890,752 | A | | 4/1999 | Lin | |
| 5,947,534 | A | | 9/1999 | Zarzycki, Jr. | |
| 6,000,733 | A | | 12/1999 | Linder | |
| 6,009,732 | A | | 1/2000 | Haeck et al. | |
| 6,048,000 | A | * | 4/2000 | Geringer et al. | 292/92 |
| 6,205,825 | B1 | * | 3/2001 | Haeck et al. | 70/92 |
| 6,386,597 | B1 | * | 5/2002 | Walsh, III | 292/92 |
| 6,394,508 | B1 | * | 5/2002 | Zehrung | 292/92 |

* cited by examiner

PANIC EXIT DEVICE MOUNTING PLATE

This application is a continuation of U.S. patent application Ser. No. 09/434,533 filed Nov. 5, 1999, now U.S. Pat. No. 6,205,825 which is a divisional application of U.S. patent application Ser. No. 09/056,261, filed Apr. 7, 1998 U.S. Pat. No. 6,009,732, both of which are incorporated by reference for all purposes into this application.

BACKGROUND OF THE INVENTION

1. Field of the Invention

The invention pertains to door hardware, and more particularly to a panic exit device with a pad actuating device. The latching mechanism includes a quick reaction deadlock actuator as well as a "dogging" mechanism to hold the latch in an open position.

2. Description of Related Art

Push pad actuators are commonly used on doors in public settings. The push pad translates a user's push into the unlatching of the doors latch mechanism, allowing the pedestrian entry or exit. For example, U.S. Pat. No. 3,614,145 entitled "Dogging Device for Panic Exit Latch and Actuator Assembly" discloses a standard push pad assembly which translates a forward motion to the pad into a lateral motion withdrawing a latch bolt from a strike plate. Motion of the push pad is translated into the lateral movement of the latch. A control member and an actuator element are connected to the latch by lost-motion connection means so that the latch bolt can be retracted by the control member without changing the position of the actuator element and so that the latch bolt can be retracted by the actuator element without changing the position of the control member.

Push pad actuators are attached to doors by bolts and other fasteners. The bolt pattern however is typically unique to each manufacturer. Thus, if the actuator is replaced, the user is prompted to buy another from the same manufacturer to avoid having to redrill holes in the door. Thus, a need exists for a modular mounting plate that would allow the user to first mount the plate using the existing bolt pattern in the door and then mount the actuator to the mounting plate.

Push pad actuators are also mounted on fire doors. A fire door is one that blocks the progression of a fire between the various rooms in a building. The latch mechanism on a fire door must become inoperable in the event of a fire. Thus, a need exists for a latch mechanism that incorporates a meltable element that blocks the normal motion of the latch in the presence of sufficiently elevated temperatures.

A need also exists for a method of quickly locking the latching mechanism into an open position. "Dogging" devices have been used to perform such a function. However, a need exists for an improved dogging device that is not attached to the push bar. In other words, the dogging device should be a modular component in the panic exit assembly.

SUMMARY OF THE INVENTION

The present invention relates to a panic exit device and fire exit device used on doors in schools, hospitals, public buildings and other commercial buildings. The device comprises a latching mechanism combined with a pad actuating mechanism. The device incorporates several novel features including: (1) an improved latch deadlocking mechanism; (2) an improved latch to pad mechanism; (3) a pad lock down feature; (4) an improved universal mounting plate and easily mounted strike; and (5) a vertical rod-bottom bolt deadlocking mechanism in its center case.

The latch deadlocking mechanism includes a latch bolt that engages a strike mounted on a door frame. When the latch bolt is in the locked position, the auxiliary bolt controls a locking finger, also called a deadlock link. The link is designed to block the retraction of the latch bolt if the auxiliary bolt is retracted first, or in the event of a fire. The deadlock link locks directly against the link connected to the latch bolt. This position makes the deadlock link very responsive and quick to react to improve security. Further, by having the auxiliary bolt wrap around the latch bolt, the assembly is "non-handed" and does not require any special bosses on the strike to rub against. The top surface of the main carriage link moves the deadlock link out of engagement. A firelock roller is suspended between two nylon spacers adjacent to the deadlock link. In the event of a fire, the nylon spacers melt and the roller drops into a position which blocks the movement of the deadlock link, thereby forcing it into engagement with the latch bolt link.

The present exit device is constructed in two basic mechanisms, the pad mechanism and a center case mechanism. The pad mechanism has an action rod and support structure. The center case mechanism can be a rim style latch bolt or the center mechanism for a vertical rod or mortise device. The action rod will give motion to the center case mechanism. The two mechanisms are produced separately and combined to create the final device. The design utilizes a unique attachment hook design that easily couples the two units together during mounting.

In normal use, it is sometimes desirable to lock down the push pad of the device making the pad inoperable. This allows the door to be opened by simply pushing against any part of the door. A "dogging" device is used to lock the action rod used by the push bar in a retracted position. The present dogging device is not attached to the push bar. Further, it is easy to install or change to a different style mechanism. Various styles of dogging devices can be used with the panic exit including hex key, cylinder or electrical versions, therefore making manufacturing modular. The cylinder design also presents quick action locking, usually requiring less than a one eighth turn.

The invention further includes the use of a universal mounting plate. For fire doors to remain rated, they must not contain extraneous holes. Thus, various manufacturers will use unique mounting hole patterns for their door hardware. Thus, once a first brand is mounted, it cannot be replaced by another brand without the need to drill new holes in the fire doors and allowing earlier drilled holes to go unused. The present invention utilizes a separate mounting plate which can include the hole pattern that matches the earlier used hardware.

Finally, a vertical rod-bottom bolt deadlocking mechanism can be located in the center case. This style of mechanism is typically used with double doors and provides two point latching with a strike in the door and a strike in the floor. Prior art mechanisms have a latch on the floor with deadlocking in it. This concept uses a bolt in the floor but a deadlock in the center case, thus keeping the bottom bolt very simple. The vertical rod device has a top and bottom bolt with a deadlocking feature on each bolt to improve security. However, the bottom bolt maintains a low profile to meet the requirements of the Americans with Disabilities Act. The present design solves this problem by moving the deadlocking mechanism into the center case mechanism. The design is non-handed and utilizes a carriage assembly that carries the deadlock feature.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE INVENTION

Figure 1:
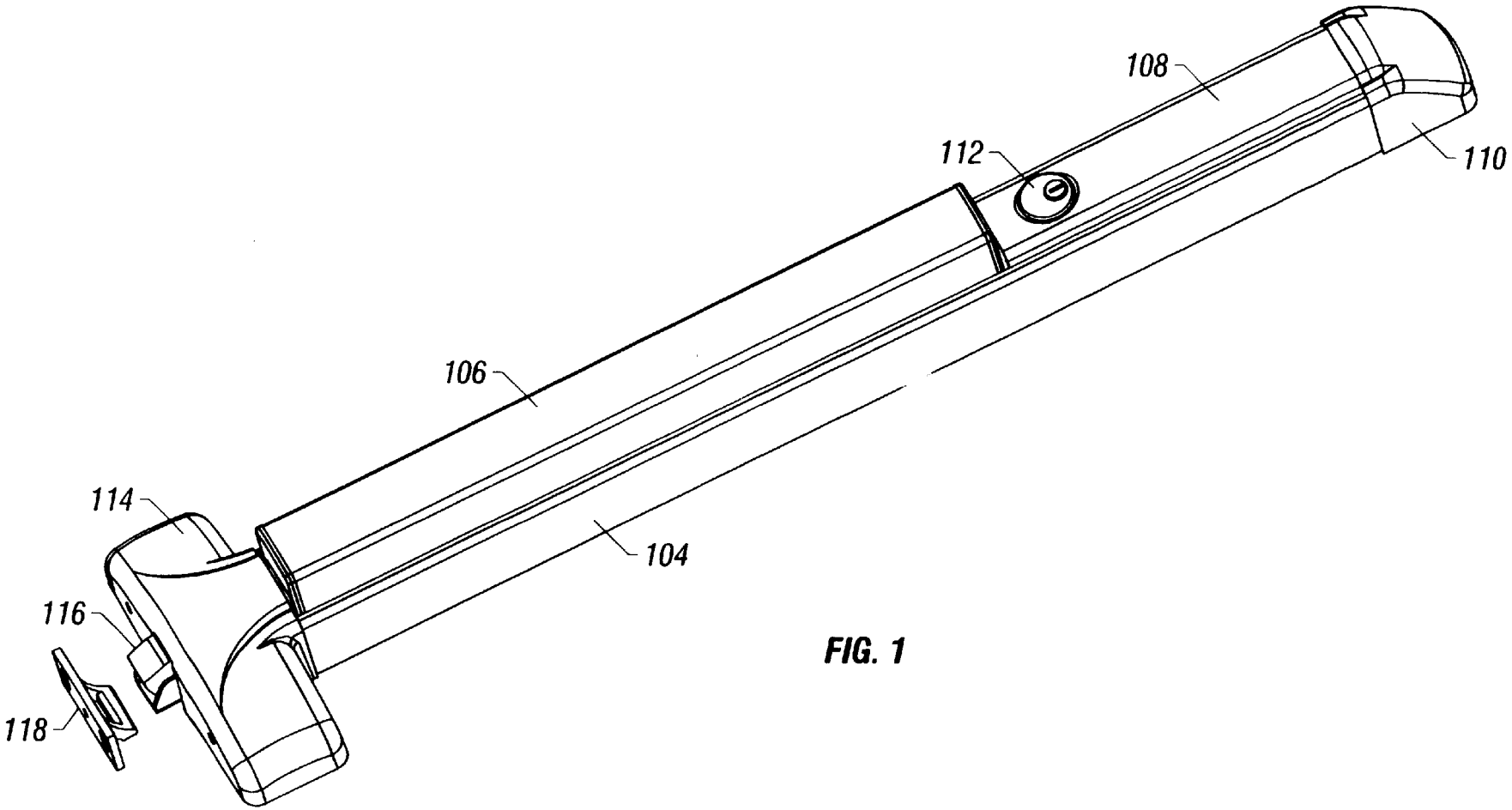
FIG. 1 is a perspective of a panic exit device embodying the present invention.
Figure 2:
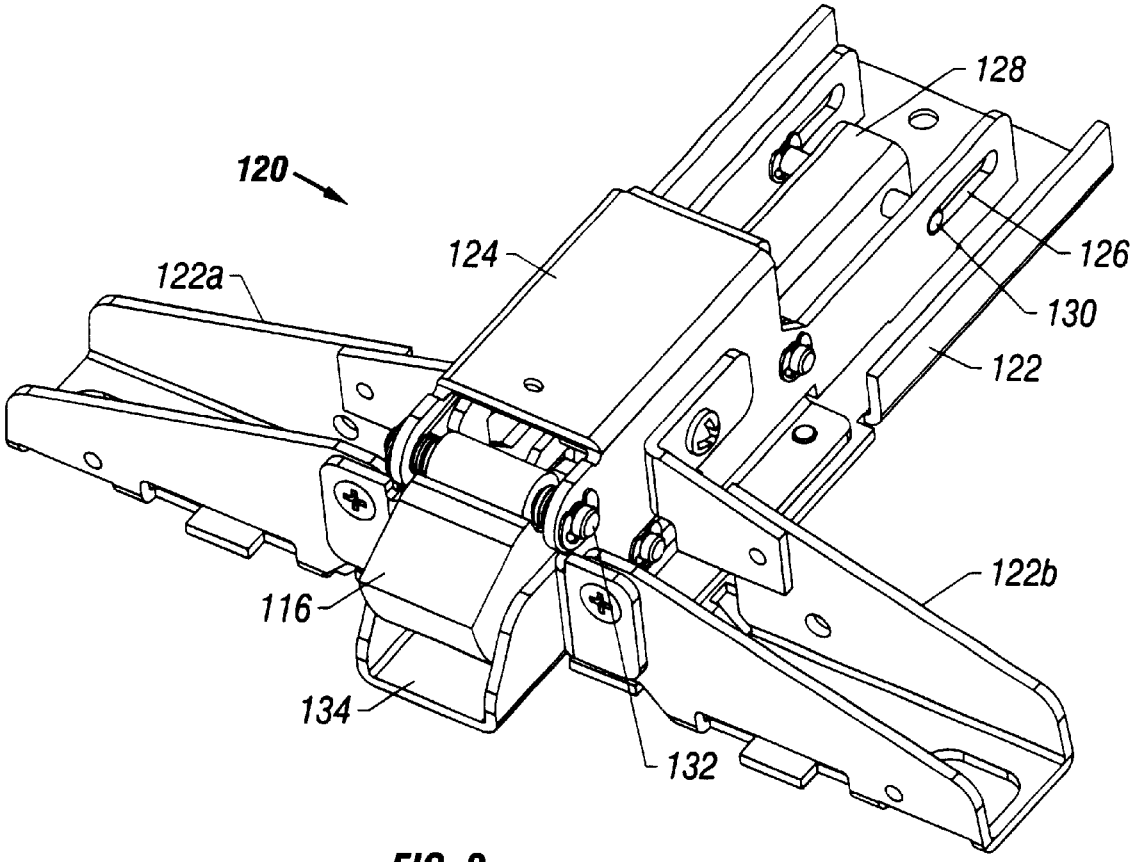
FIG. 2 is a detailed perspective of the rim latching mechanism.
Figure 3:
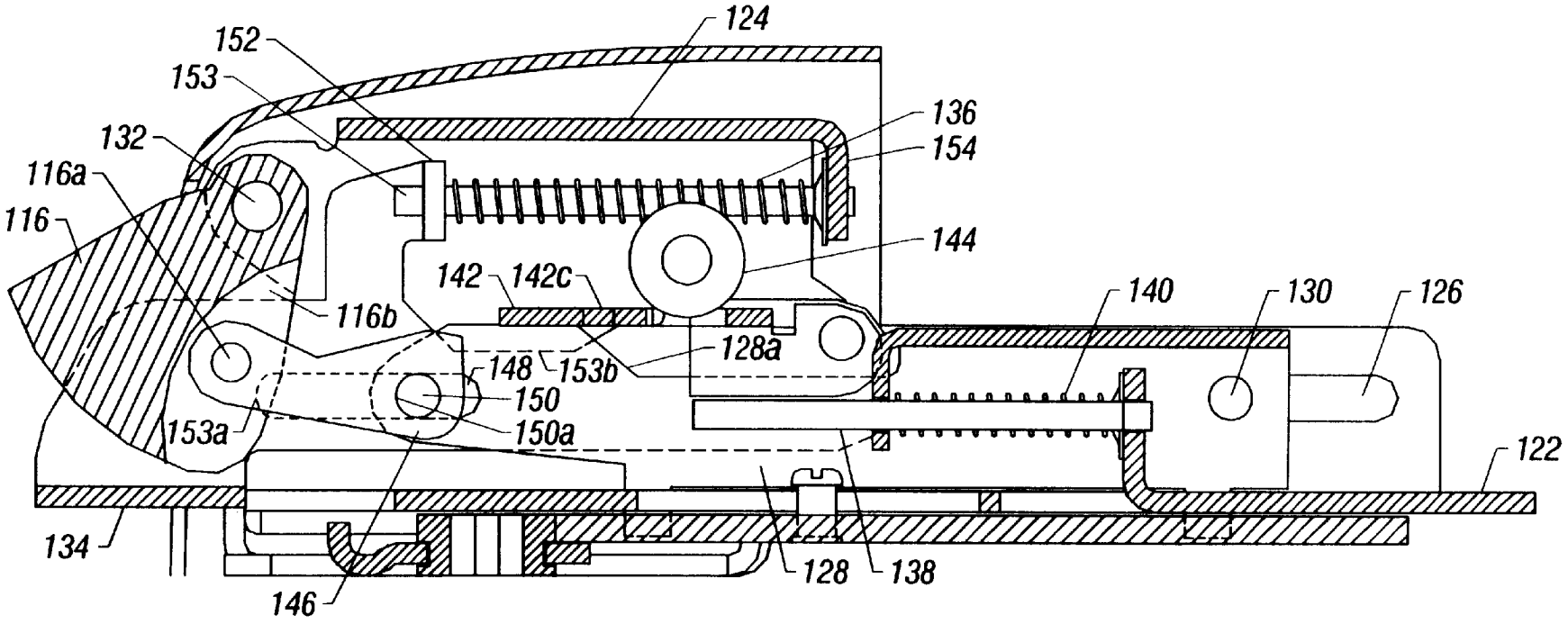
FIG. 3 is sectional view across the latching mechanism.

The panic exit device of the present invention improves upon prior art devices in several areas. First, it incorporates an improved latch deadlocking mechanism. The improved design is shown in FIGS. 1 to 3. Second, the device includes an improved latch to pad mechanism shown in FIG. 4. Third, the device includes a pad lock down feature shown in FIGS. 5 and 6. Fourth, the device uses an improved universal mounting plate and easily mounted strike. These features are shown in FIGS. 7 to 10. Finally, the panic exit device includes a vertical rod-bottom bolt deadlocking mechanism in its center case, shown in FIGS. 11 to 14.

Referring to FIG. 1, a panic exit device 100 has a baseplate 102 (not shown) covered by a housing 104. A push bar 106 is captured by the baseplate 102 so that it can move between a first, outward position and a second inward position. The push bar 106 can extend the entire length of the baseplate, but in a preferred embodiment, only extends a portion of the length of the baseplate 102. A case filler 108 can be used to fill the unused length of the baseplate. An end cap 110 can be used to prevent any lateral movement of the push bar 106 or case filler 108. The end cap 110 also presents a smoother surface. The case filler 108 can have an opening to accept a dogging mechanism 112 which is coupled between the case filler 108 and the push bar 106. As will be discussed in greater detail, the dogging mechanism 112 is used to lock the push bar in its second, inward, and open position. Finally, a latching mechanism is housed under a rim cover 114. The latching mechanism includes a latch bolt 116 which engages a strike 118 located on a door frame (not shown).

FIG. 2 is a perspective view of the latching mechanism 120. The latching mechanism generally includes a vertical housing 122 which is mounted flush to the door, and a horizontal housing 124 which extends outward from the vertical housing 122. The horizontal housing encloses a main link carriage 128 which retracts in response to the movement of the push bar 106. The main link carriage is coupled to both the latch bolt 116 and to an auxiliary bolt 134. The latch bolt 116 is connected to the horizontal housing by a latch bolt pin 132.

Referring to FIG. 3, the latch bolt 116 is connected to the main link carriage 128 by a latch bolt link 146. The latch bolt link 146 is attached to latch bolt 116 by a pin 116*a*. Latch bolt link 146 can pivot in a groove 116*b* in the latch bolt 116. Further, the latch bolt link 146 can travel within a groove 148 in the main link carriage 128. In other words, when the carriage 128 is being retracted, a pin 150 coupling the link 146 within the groove 148 must impact against groove surface 150*a* before the latch bolt 116 pivots to its open position (out of engagement with the strike). Several springs bias the latch bolt 116 and auxiliary bolt 134 into a forward and engaged position. At least one auxiliary bolt spring 136 is suspended around rod 153 and is captured between a flange 152 of the auxiliary bolt 134 and a flange 154 of the horizontal housing 124. Auxiliary bolt spring 136 biases the auxiliary bolt 134 in an extended position. Spring 140 biases the main link carriage 128 forward against vertical housing 122 to an extended position.

Auxiliary latch bolt 134 has several important features. First, slot 153*a* allows the latch bolt to be partially retracted without requiring movement of latch bolt 116. Additionally, auxiliary latch bolt 134 has an indention 153*b* having graduated sides on its left and its right as shown in FIG. 3. Indention 153*b* is positioned directly below arm 142*c* of link 142 as shown in FIG. 3*i* and as will be discussed later. Pin 150 is positioned within slot 153*a*. As latch bolt 116 is retracted, pin 150 presses against the right side of slot 153*a* and forces auxiliary bolt 134 to retract.

Figure 3A:
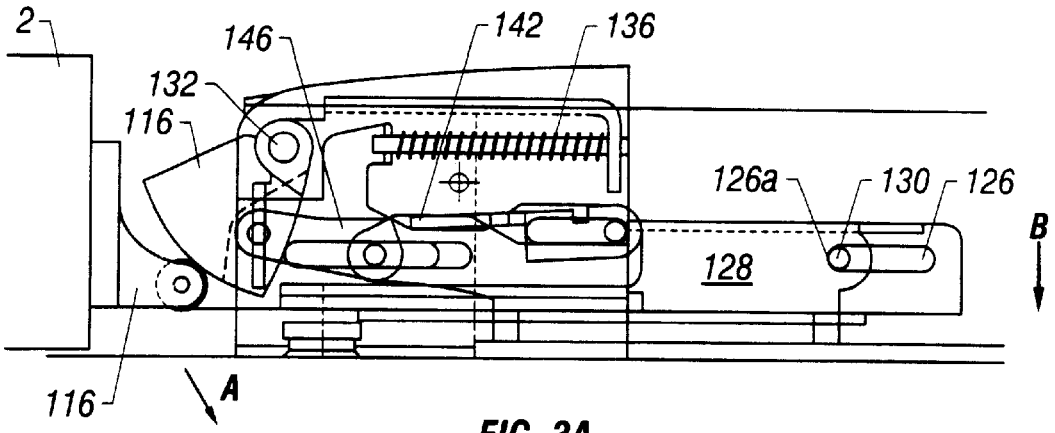

FIGS. 3*a* to 3*h* illustrate the steps involved when retracting the latch bolt 116. In FIG. 3*a*, the latch bolt 116 is shown in an extended position and in contact with the strike 118. The strike is shown attached to a door frame 2. In this position, the door on which the panic exit device is mounted cannot be opened in the direction shown by arrow A. A torsional spring 156 (shown in FIG. 3*a*) biases the latch bolt 116 in this position. As the push bar 106 is pressed, its forward movement is translated into the lateral movement of the main link carriage 128. This connection will be discussed in more detail below. In the fully closed position, the pin 130 contacts the forward edge 126*a* of grooves 126. The latch bolt link 146 couples the main link carriage 128 to the latch bolt 116. Auxiliary bolt 134 is retracted against strike 118. This occurs as the door closes. The latch bolt 116 is now secure. Should one push the push bar (not shown) in the direction of arrow B, main link carriage 128 would pull latch bolt link backwards which in turn would cause the latch bolt 116 to rotate about pin 132 to move latch bolt link 146 out of contact with surface 142*a* of the deadlock link 142. The deadlock link is biased to rotate into contact by a deadlock spring. In the forward position of main link carriage 128, the deadlock link 142 is allowed to rotate to this contact position. The front slot in 128 allows the deadlock link 146 to travel backward without the main link carriage 128 moving. This is clearly shown in FIG. 3*h*. When the latch bolt is in the retracted position (latch bolt link 146 contacting surface 142*a*) this interlock can be removed when pad 106 is actuated. As the main link carriage 128 moves back, a ramp engages side tabs on the deadlock link 142. This rotates deadlock link surface 142*a* out of contact with the latch bolt link 146 and the bolt is free to retract. The link 142 is shown in FIG. 3*i*.

Figure 3B:
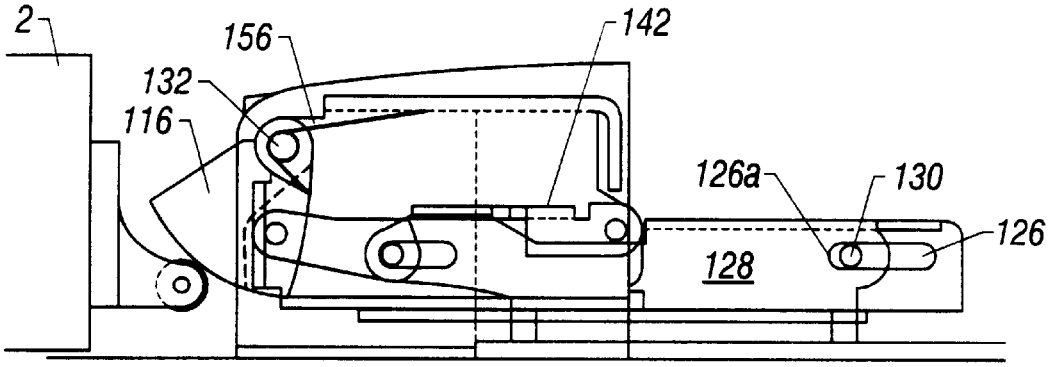
Figure 3C:
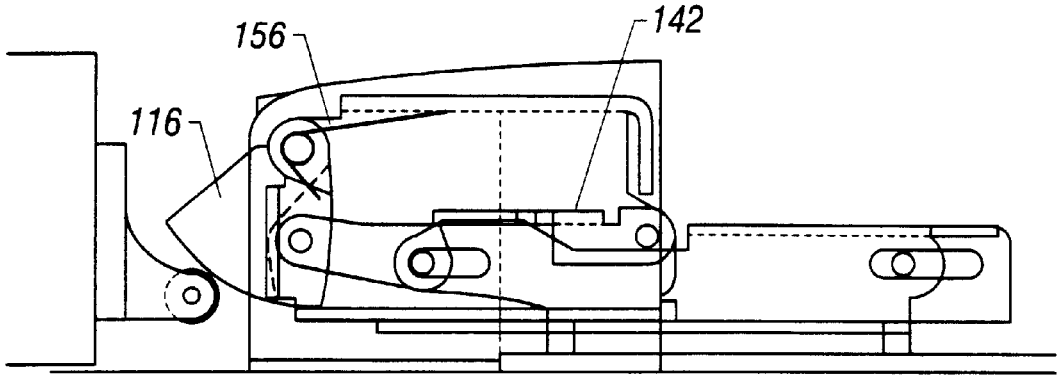
Figure 3D:
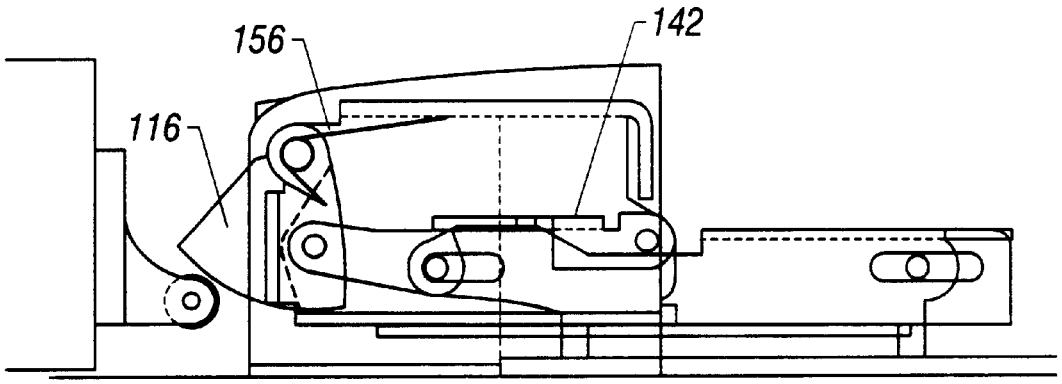
Figure 3E:
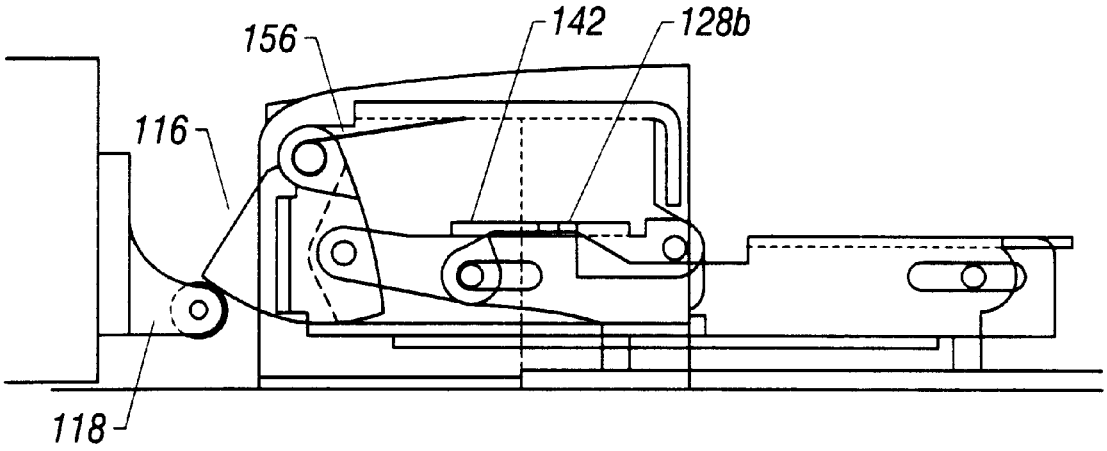
Figure 3F:
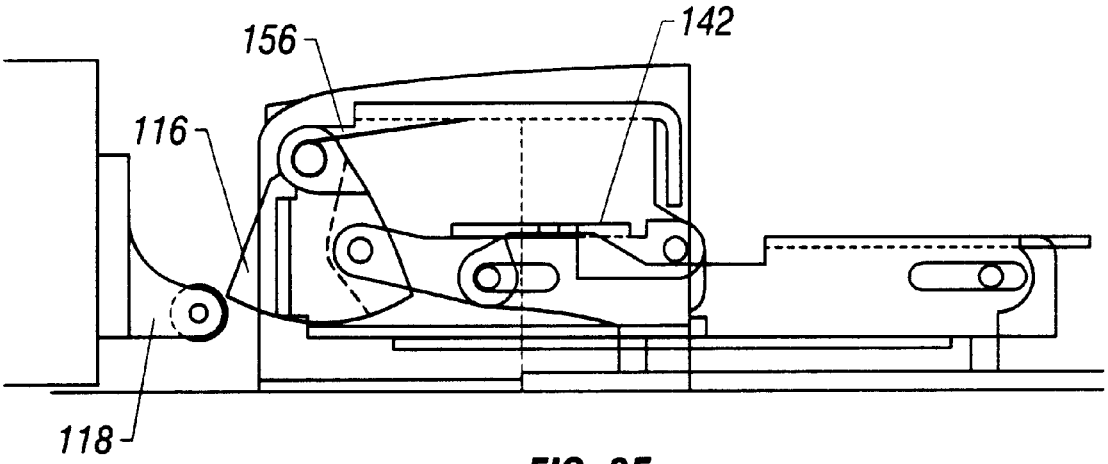
Figure 3G:
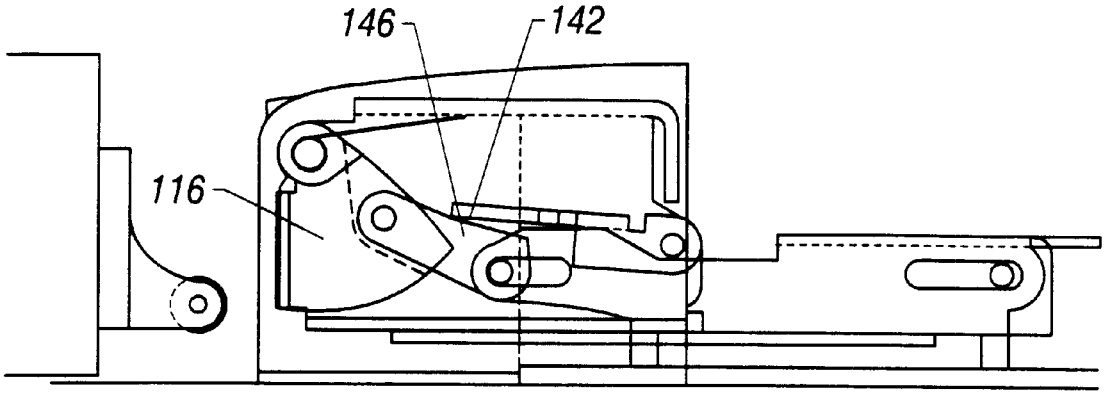
Figure 3H:
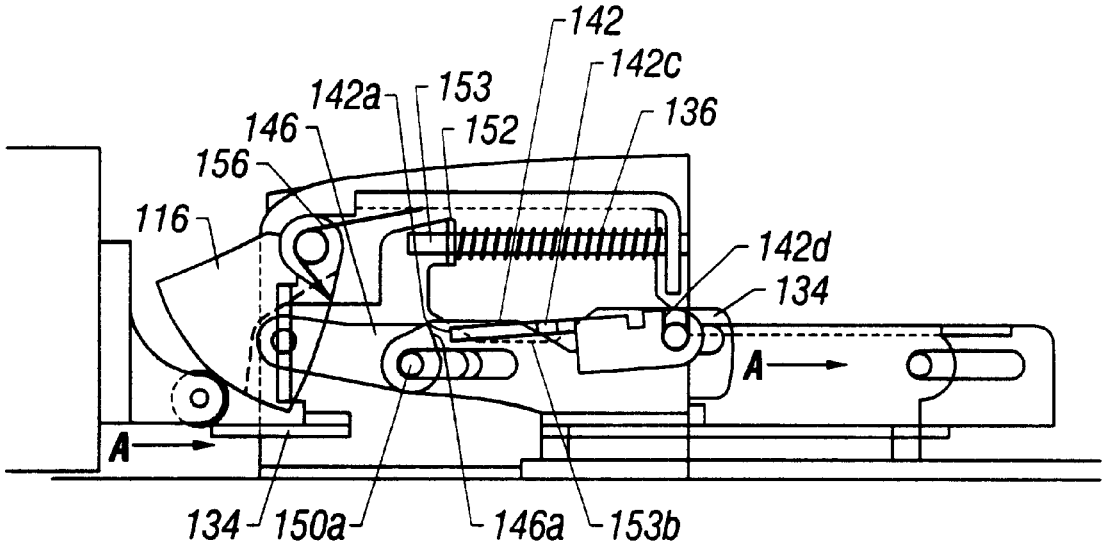
Figure 3I:
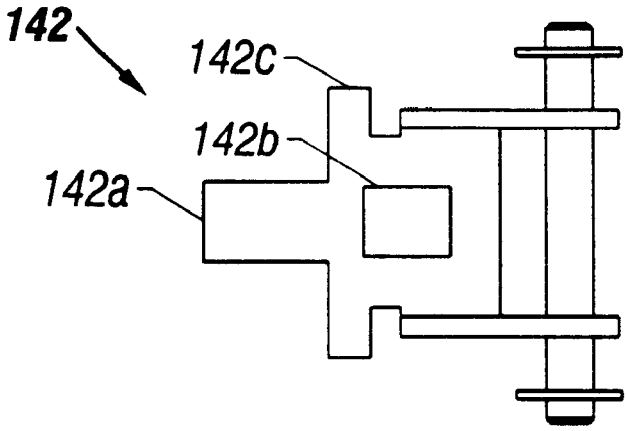

FIG. 3*b* illustrates the behavior of the device when the main link carriage 128 is translated a small distance. The pin 130 no longer contacts the forward surface 126*a* of grooves 126. The latch bolt 116 pivots around latch bolt pin 132. The force of torsional spring 156 must be overcome to accomplish this movement. The general progression of the latch bolt is clearly illustrated in progressive FIGS. 3*c*, 3*d*, 3*e*, and 3*f*. Finally, the latch bolt is in its fully retracted position as shown in FIG. 3*g*. It is important to note the position of deadlock link 142 during the progression. At first, the deadlock link 142 contacts a forward portion 128*a* of the main link carriage 128. Specifically, the forward portion 128*a* has a top surface 128*b*. The deadlock link 142 can slide against the top surface 128*b* until it contacts the latch bolt link 146, at which point it slides across its top surface as shown in FIGS. 3*f* and 3*g*. The deadlock link 142 serves the important purpose of blocking the retraction of the latch bolt 116 in certain situations. For example, FIG. 3*h* illustrates the situation where only the auxiliary bolt 134 is partially retracted in direction A. In this instance the deadlock link pivots to a position in the path of the latch bolt link. In other words, the forward surface 142*a* will abut the rear surface 146*a* of the latch bolt link 146, preventing the latch bolt 116 from retracting. This motion is accomplished because side tabs 142*c* of deadlock link 142 slide down the incline sides of indention 153*b* in auxiliary bolt 134. Torsional spring 142*d* biases dead lock link 142 in a downward position while tab 142*c* is resident in indention 153*b*.

Figure 3J:
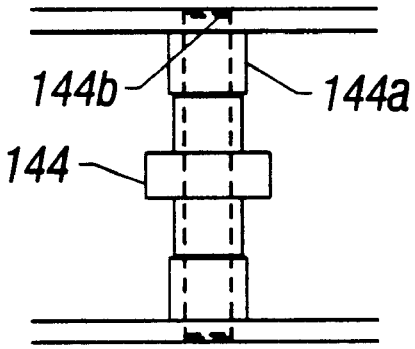

The deadlock link 142 has a central opening 142*b*, shown in FIG. 3*i*, which accepts the central portion of the firelock roller 144. The firelock roller does not disturb the motion of the deadlock link 142 in normal operation. However, in the event of a fire, the elevated temperature will melt the nylon spacers 144*a* of the roller 144, releasing its central larger diameter roller to fall into a position that does block the normal motion of the link 142. In the blocking position, the roller 144 pins the link 142 so that it will engage the latch bolt link 146 as discussed above. The roller 144 is more clearly illustrated in FIG. 3*j*. A pin 144*b* holds the roller 144 in place.

Figure 4:
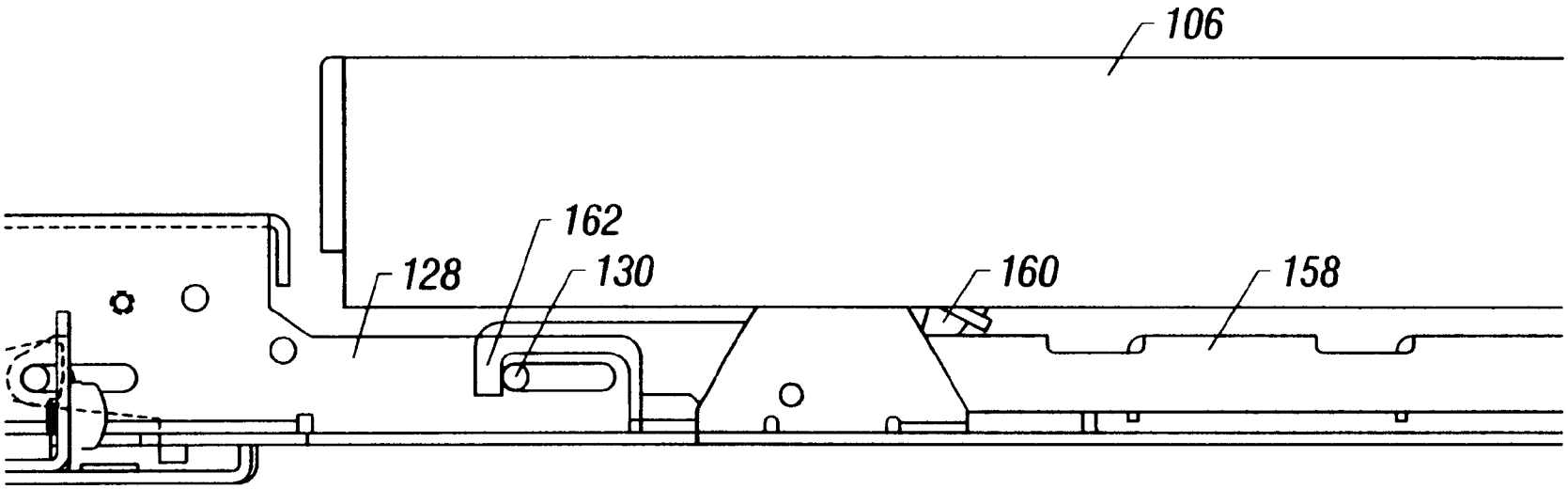
FIG. 4 is a partial sectional view across the length of the push bar mechanism showing the attachment between the push pad actuator and the latching mechanism.

FIG. 4 illustrates the improved latch to pad mechanism that translates the forward motion of the push bar 106 into the lateral motion of the main link carriage 128. The push bar 106 is connected to an action rod 158 by a rocking mechanism 160. The rocking mechanism 160 translates the forward motion applied to the push bar into lateral movement of the action bar 158. The action bar is coupled to the main link carriage 128 by a hook 162 which engages pin 130. The latch assembly 120 and the assembly of the push bar 106 and action bar 158 are produced as modular assemblies. The modules are easily assembled with a hook 162. Screws are used to keep the components assembled in the final assembly. Another advantage to the modular assemblies is that different styles of latch assemblies and push bar needed to meet different specifications, such as a electrical operation or different bolt patterns for different replacement applications can be produced and then linked together easily in many different configurations. The modular construction also has the advantage of reducing the inventory required to retrofit a large number of existing bolt patterns and applications.

FIGS. 5, 6*a*, 6*b*, and 6*c* illustrate the interaction of the dogging mechanism 112 with the action rod 158 and lock cylinder 112*a*. The dogging mechanism 112 is mounted to a bracket 166 which is affixed to case filler 108. Since the dogging mechanism is not fixed to the base plate 102, it can be easily removed in the factory or during installation for maintenance or upgrading.

Figure 5:
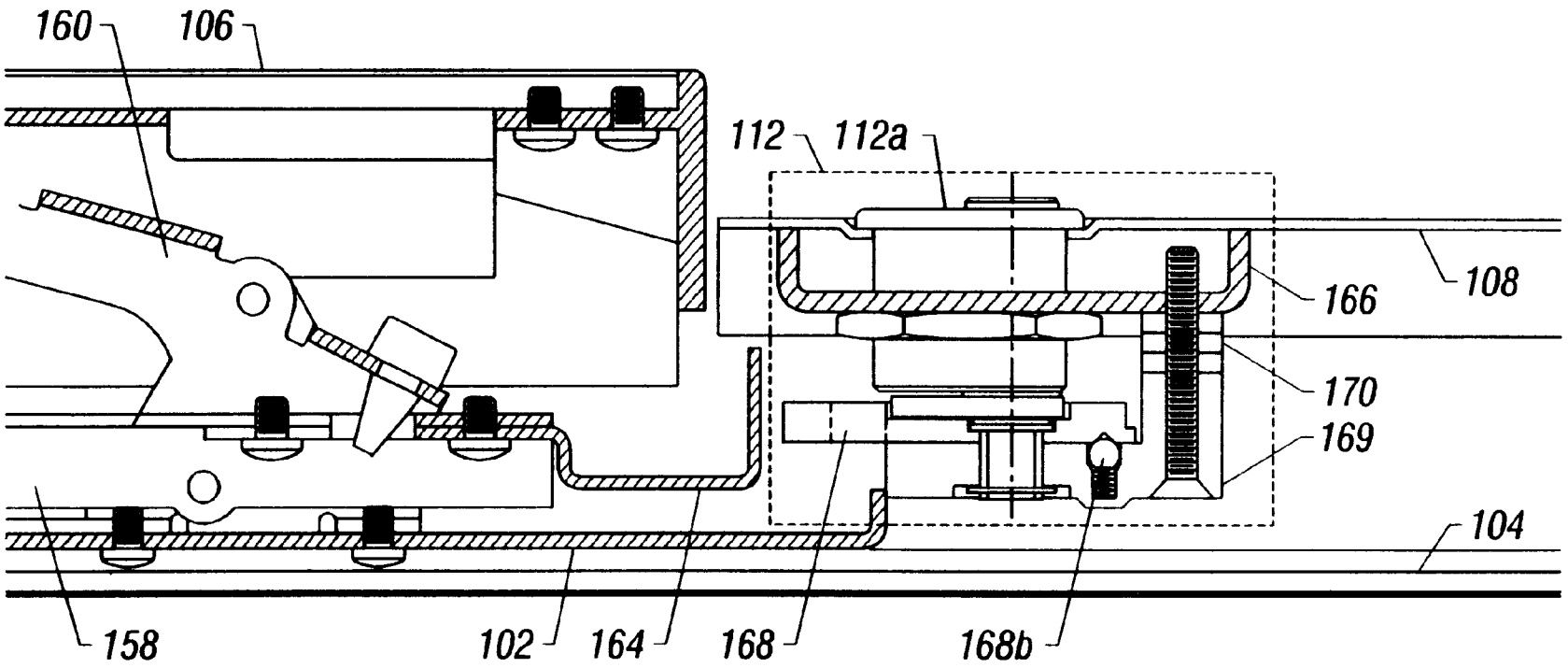
FIG. 5 is a partial sectional view showing the key cylinder used to "dog" the latch in an open position.
Figure 6A:
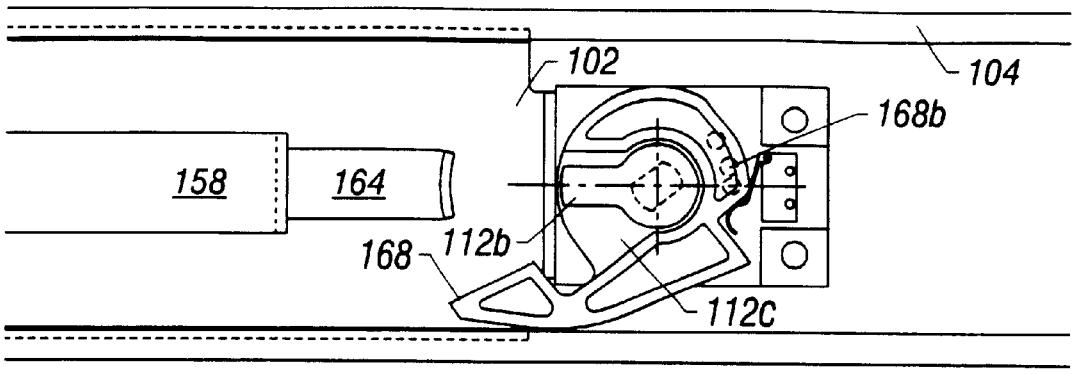
FIG. 6 is a top view of the locking mechanism shown in FIG. 5.
Figure 6B:
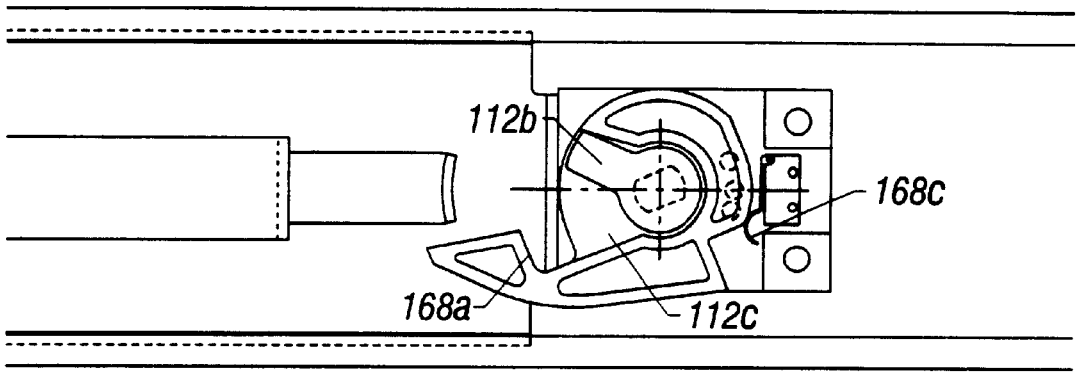
Figure 6C:
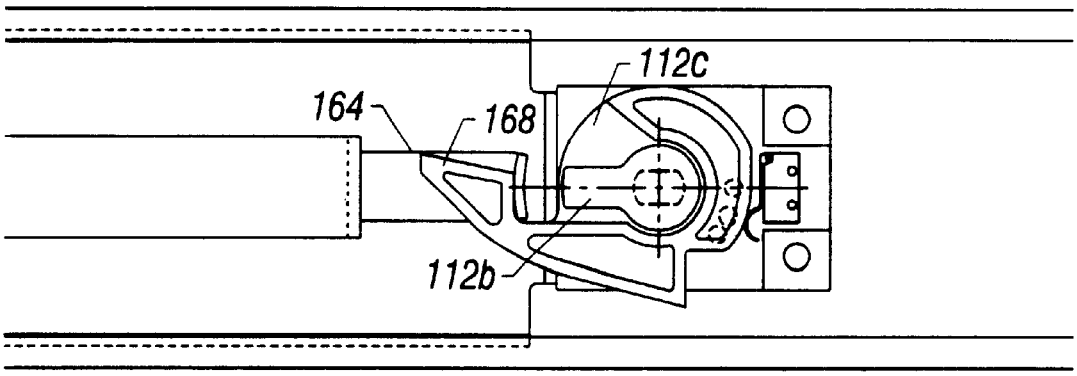

The dogging mechanism 112 comprises a lock cylinder 112*a*, dogging bracket 169, latching element 168, and dogging detents 168*b*. Dogging bracket 169 couples to bracket 166 as shown in FIG. 5. Shims 170 can be used for height adjustment as required. Latching element 168 has a cam surface 168*a* which can engage a second hook element 164 on the action bar 158 when the latch bolt is disengaged from the strike. During rotation of the dogging mechanism, shown in FIGS. 6*b* and 6*c*, the cam surface 168*a* engages the action bar 158 when it is in a retracted position, thus dogging the latch bolt into an open position. In order to rotate dogging mechanism 112, a key is inserted into lock cylinder 112*a*, shown in FIG. 5 which is coupled to tail piece 112*b* as shown in FIGS. 6*a*–6*c*. tail piece 112*b* slides in slot 112*c* in latching element 168. As tail piece 112*b* reaches either side of slot 112*c*, it causes latching element 168 to rotate and engage or disengage the action rod. Slot 12*c* can be made variable widths to accommodate different rotational requirements of different commercially available lock cylinders as well as to allow the key to be rotated back to its home position for removal.

Detents 168*b* allow the dogging mechanism to be positively positioned in a variety of positions. For example, three detents are shown in the figures. The detents can serve other purposes as well. For example, when the dogging mechanism is in the second detent, FIG. 6*b*, then an electrical contact 168*c* could be made to initiate an electrical control signal, for instance, to control a security notification, solenoid or other apparatus. If a solenoid were actuated, it could possibly even retract the action bar. FIG. 6*c* illustrates the dogging mechanism seizing the action rod in position.

Figure 7:
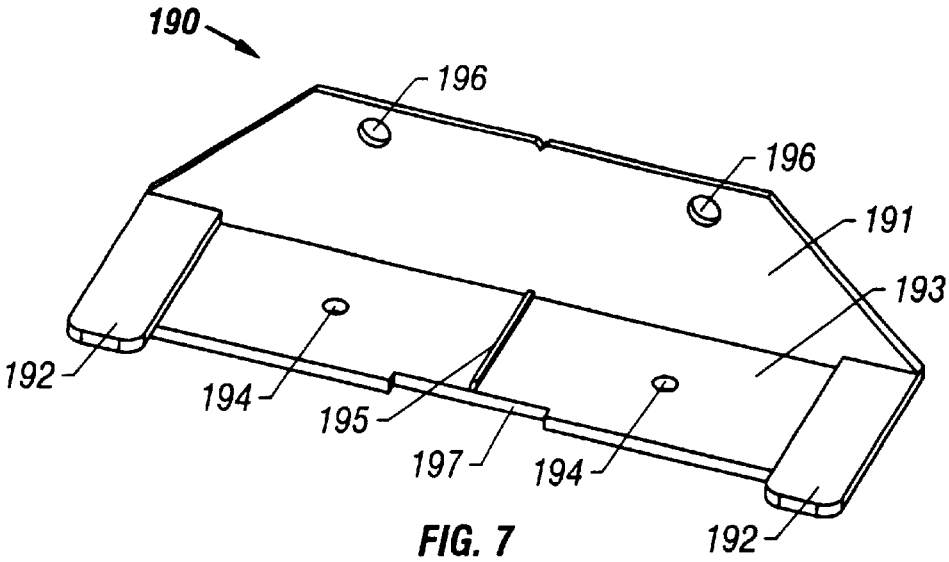
FIGS. 7 to 10 illustrate the mounting plate design and strike plate locator.
Figure 8:
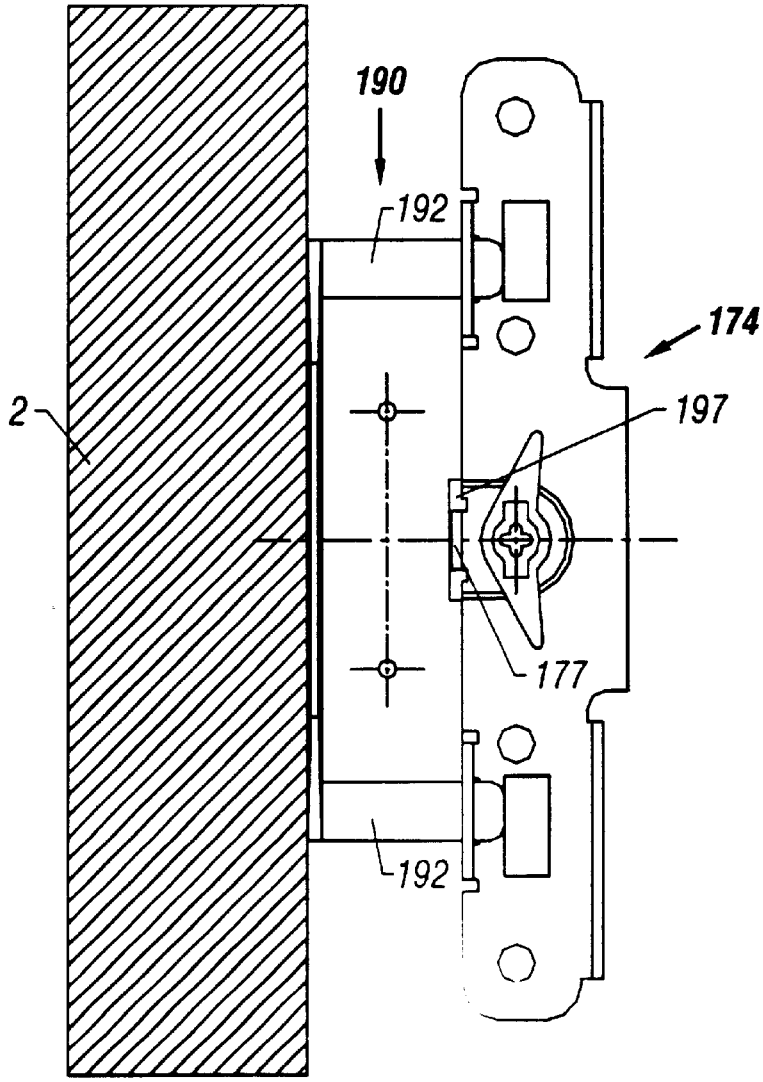

FIGS. 7 and 8 illustrate a strike locator 190 for locating strike 118 for use with panic exit device 100. Strike locator 190 has a first side 191 and a substantially perpendicular second side 193. First side 191 has a pair of strike holes 196. In one embodiment, second side 193 has a substantially centered alignment mark 195. In another embodiment, second side 193 has a generally centralized relief 197. In another embodiment, second side 193 has two outwardly extending tabs 192. In another embodiment, tabs 192 are positioned in a plane immediately above second side 193. In another embodiment, second side 193 has a pair of mullion holes 194.

Figure 9:
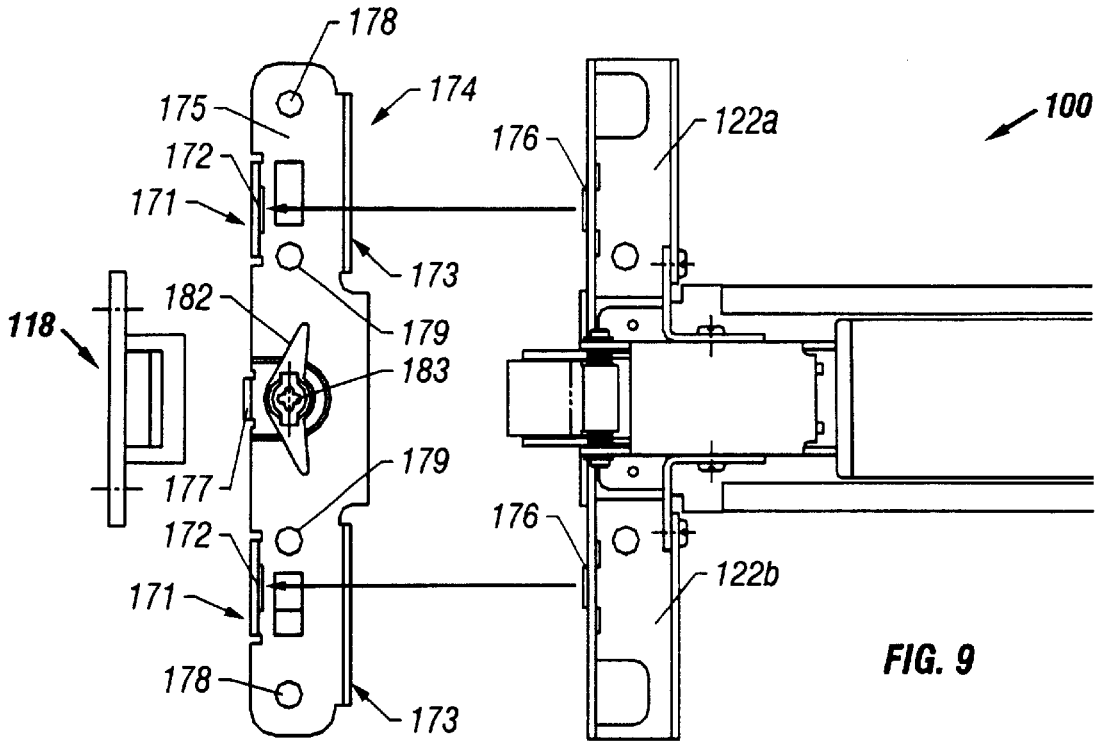

Referring to FIG. 8 and FIG. 9, a mounting plate 174 is disclosed. In a preferred embodiment best seen in FIG. 9, mounting plate 174 comprises a substantially planar base 175. A pair of upturned outside flanges 171 extends from base 175. Slotted apertures 172 are located in outside flanges 171. A pair of upturned inside flanges 173 extends from base 175. In one embodiment, inside flanges 173 are substantially parallel to outside flanges 171. In another embodiment, a cam 182 is rotatably mounted substantially in the center of mounting plate 174. An aperture 183 is centrally located on the pivot axis of cam 182. In one embodiment, aperture 183 is cruciform shaped. In another embodiment, a cam limiter tab 177 extends upward and outward from base 175. Outside mounting holes 178 are located on base 175 in generally opposite relation to the center of mounting plate 174. Inside mounting holes 179 are also located on base 175, in generally opposite relation to the center of mounting plate 174.

Referring to FIG. 9, a panic exit device 100 connectable to mounting plate 174 is disclosed. In an embodiment of the present invention, tabs 176 extend from upper legs 122*a* and lower legs 122*b* of vertical housing 122 of panic exit device 100.

Strike locator 190 provides a simple, convenient, and accurate means for mounting strike 118 and mounting plate 174. In a new installation, a locating mark is made on the unhinged side of door 4 at a height desirable for the location of panic exit device 100, as is commonly done with existing devices. Strike locator 190 is placed on door 4 in alignment with the locating mark made on door 4. As would be obvious to anyone skilled in the art, this can be readily achieved by centering alignment mark 195 with the locating mark on door 4. With door 4 in a closed position, strike holes 196 on strike locator 190 are used to locate holes for installing strike 118 on door frame 2. As shown in FIG. 8, mounting plate 174 is abutted to strike locator 190 so that tabs 192 of strike locator 190 are received in slots 172 of mounting plate 174. In another embodiment, cam limiter tab 177 engages relief 197 of strike locator 190. In this position, mounting plate 174 is properly located for attachment to door 4. Door 4 is marked to indicate where the desired holes are to be drilled, and strike locator 190 and mounting plate 174 are removed. The holes are then drilled and mounting plate 174 is secured to door 4. Door 4 can be marked to indicate where the desired holes are to be drilled, and strike locator 190 and mounting plate 174 removed. Alternatively, the holes may be drilled, or fasteners directly installed while holding mounting plate 174 in place. Mounting plate 174 can be attached to door 4 by installation of fasteners through either outside mounting holes 178 or inside mounting holes 179. In an alternative embodiment, mullion holes 194 are used to locate the holes for mounting an interlocking hook (not shown) on a mullion.

In a retrofit installation, strike locator 190 can be utilized when replacing an existing panic mounting device with panic exit device 100, to position mounting plate 174 on door 4 in proper alignment with an existing strike or strike location. The previous strike is removed and strike locator 190 is positioned on door frame 2 such that strike holes 196 are centered on the preexisting strike location. New holes for strike 118 can be marked for drilling from strike holes 196 in strike locator 190 if necessary. As shown in FIG. 8, mounting plate 174 is then abutted to strike locator 190 such that tabs 192 of strike locator 190 are received in slots 172 of mounting plate 174. New holes for mounting plate 174 can be located for drilling through outside holes 178 and/or from inside holes 179 of mounting plate 174. Door 4 is marked to indicate where the holes are to be drilled, and strike locator 190 and mounting plate 174 are removed. The holes are then drilled and the strike 118 and mounting plate 174 are secured to door frame 2 and door 4 respectively with appropriate fasteners such as screws.

Those skilled in the art will appreciate that other arrangements of tabs and slots or other mating arrangements known in the art can be utilized on mounting plate 174 and vertical housing 122 to facilitate the proper vertical positioning and retention of exit device 100 in mounting plate 174. Once mounting plate 174 is attached to door 4, mounting plate 174 functions as both a locator and a quick mount support for installing exit device 100 by retaining device 100 in proper alignment with strike 118 until device 100 is secured.

Figure 10:
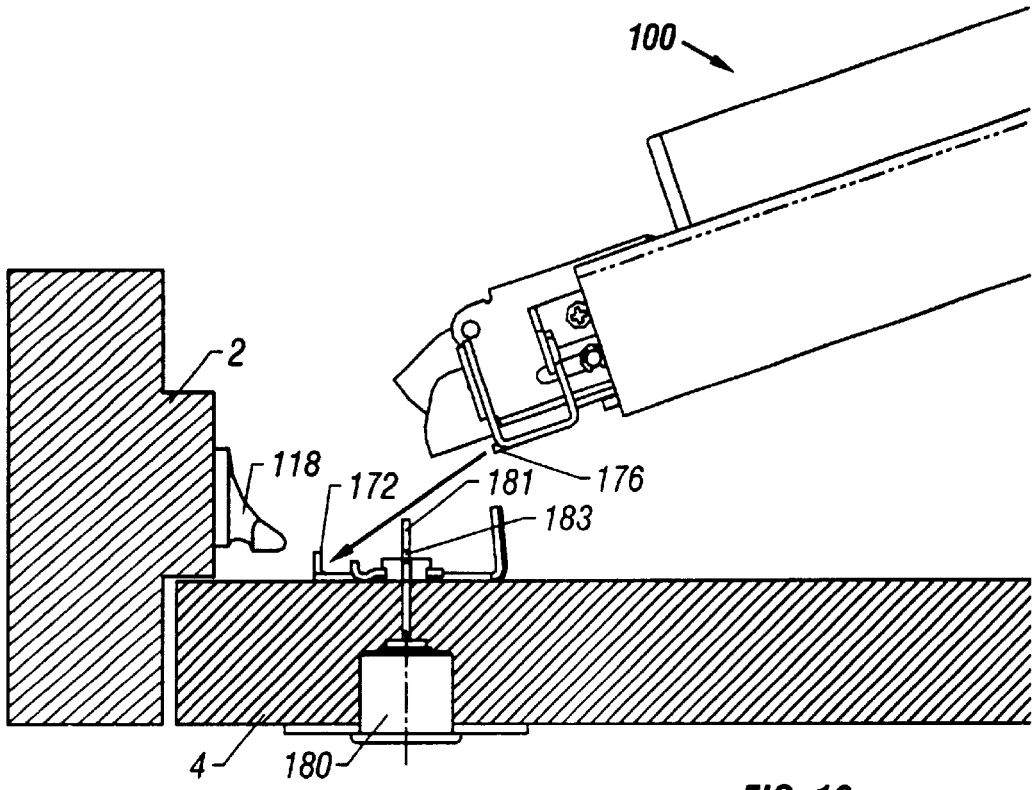

FIGS. 9 and 10 further disclose the hardware used to mount panic exit device 100 to door 4 so that it can engage strike 118 mounted on door frame 2. With mounting plate 174 securely attached to door 4, panic exit device 100 is positioned so that tabs 176 on vertical housing 122 engage slots 172 on mounting plate 174. Panic exit device 100 is then rotated into place against door 4. Outside flanges 171 and inside flanges 173 extend from base 175 thereby forming with base 175 a channel sized to receive upper and lower legs 122*a* and 122*b* of vertical housing 122 of exit device 100. Outside flanges 171 and inside flanges 173 function as stops to prevent lateral and rotational movement of exit device 100. Engagement of slots 172 with tabs 176 of vertical housing 122 prevents vertical movement of panic exit device 100.

In another embodiment, a lock device 180 can be mounted on the opposite side of door 4 substantially centered on mounting plate 174. In this embodiment, a shaft 181 extends from lock device 180 through door 4 and rotationally engages aperture 183 of cam 182. In one embodiment, shaft 181 engages a cruciform aperture 183 of cam 182. Cam 182 engages the release mechanism of exit device 100. Upon activation of lock device 180, cam 182 actuates the release mechanism of panic exit device 100; moving latch bolt 116 out of engagement with strike 118 from the opposite side of door 4.

Mounting of the panic exit device 100 is completed by installing screws in a bracket located under end cap 110. It will be appreciated that mounting plate 174 of the present invention greatly eases the process of mounting panic exit device 100. Only mounting plate 174 must be held in position on door 4 while marking or drilling the necessary holes. Another advantage of mounting plate 174 is that outside holes 178 and inside holes 179 can be variously configured to match the holes in door 4 from a previously mounted panic exit assembly. Thus, by providing separate mounting plates 174 with a variety of hole patterns, panic exit device 100 of the present invention can replace a variety of other panic exit devices.

Figure 11:
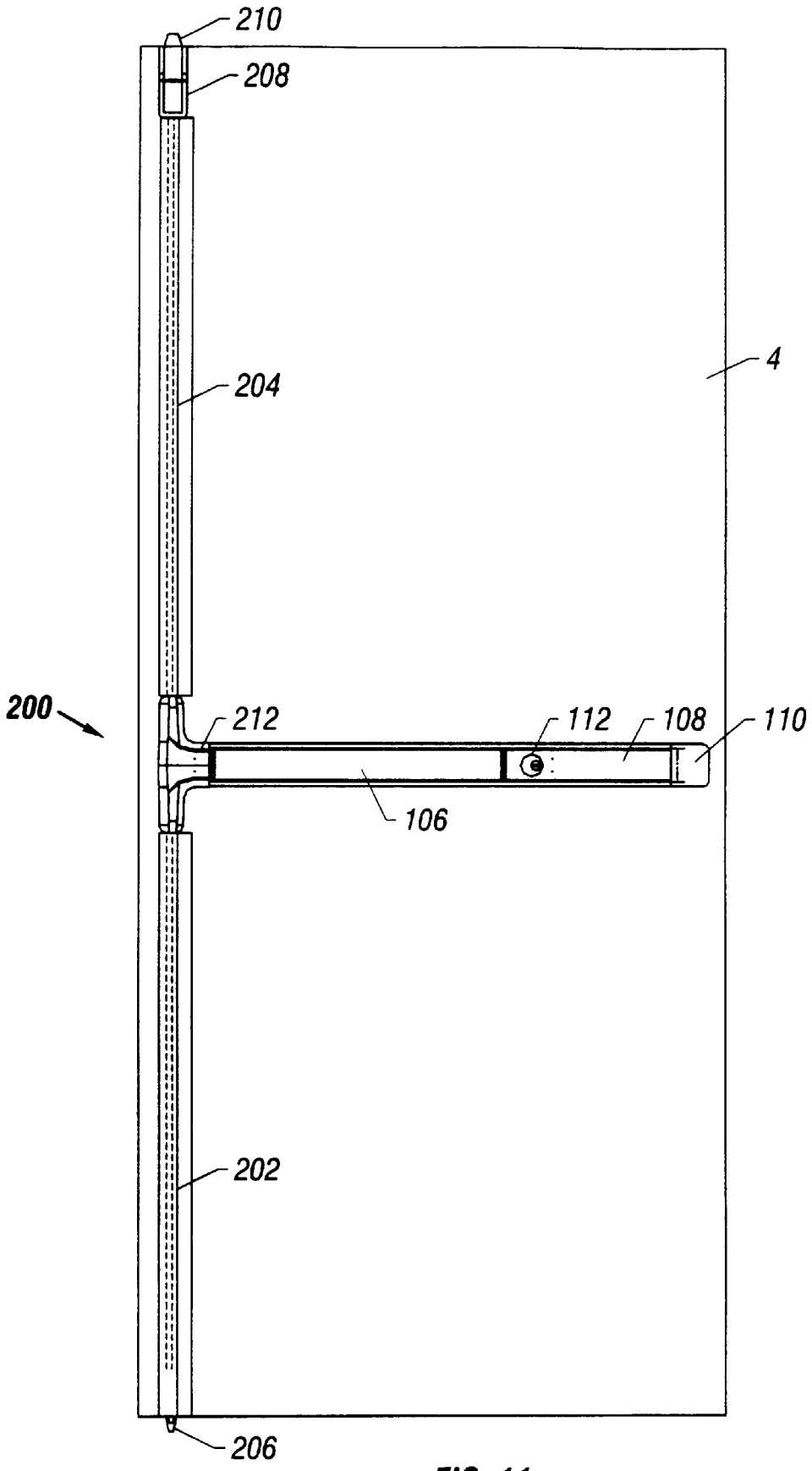
FIGS. 11 to 14 illustrate the surface vertical rod deadlocking mechanism which can be located in the center case of the door.

FIGS. 11 to 14 illustrate the use of the locking mechanism to actuate vertical rods. This style of panic exit is used primarily on double doors with a strike in the header, and a strike in the floor. In FIG. 11, only a single door 4 is shown. A push pad actuator 106 is shown mounted to the door along with a dogging mechanism 112, case filler 108, and an end cap 110. These elements operate as described above. A center case mechanism 200 under cover 212 is used to translate the motion of the Push pad 106 to a pair of vertical rods 202, 204. Rod 204 controls a latching mechanism 208 and a latch 210. Latching mechanism 208 is well known in art. As vertical rod 204 moves upward, latching mechanism 208 operates to translate the upward motion into a retraction of latch 210. Rod 202 controls the translation of a peg 206. Through cooperation of translating vertical rods 202 and 204 and latching mechanism 208, when push pad actuator 106 is pushed, both peg 206 and latch 210 are retracted so that the door may freely open. Of course, either rod could control any fashion of latch including a mechanism similar to that described in FIG. 3.

Figure 12:
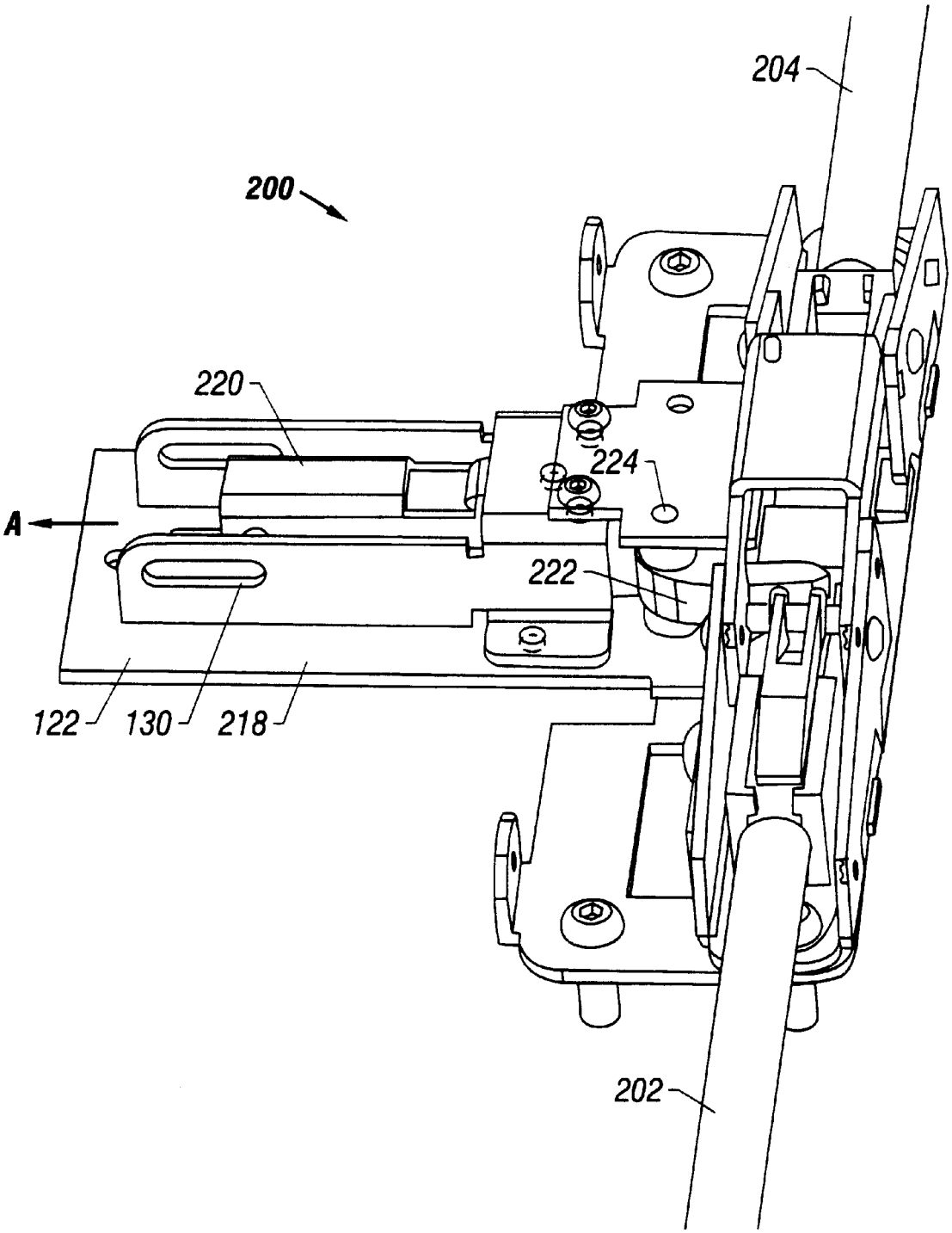
Figure 13A:
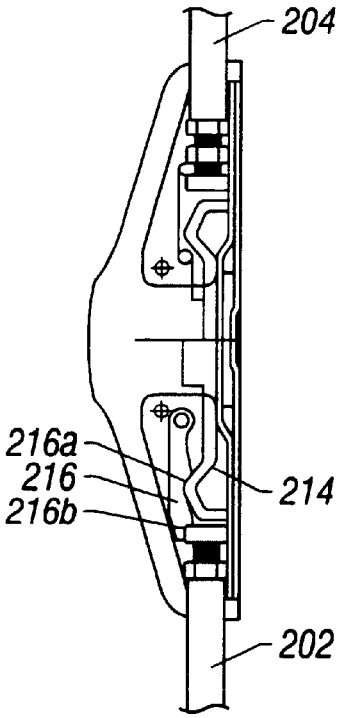
Figure 13B:
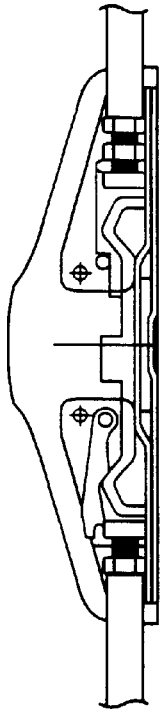
Figure 13C:
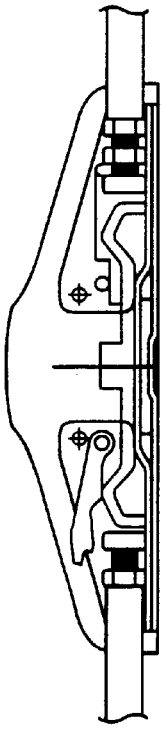
Figure 13D:
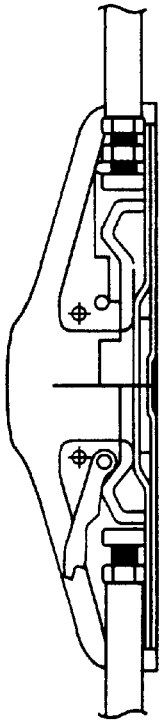

FIGS. 12, 13*a*, 13*b*, 13*c*, and 13*d* show the internal workings of the center case mechanism 200 and the pivotal deadlock lever 216. The mechanism 200 has a frame 218. A first linkage 220 is coupled to the action rod under the push pad 106. The action rod translates the first linkage 220 in the direction shown by arrow A. Motion of the first linkage translates a pair of lifting mechanisms 214, shown in FIG. 13*a*. The lifting mechanisms 214 have a bent surface which impacts surface 216*a* against a pivotal deadlocking lever 216. The motion of the lifting mechanism 214 moves the deadlocking lever out of engagement with the rod 202. As the first linkage moves, so do the lifting mechanisms, until, as shown in FIG. 13*d*, the rods 202, 204 are raised to the fullest extent required from center case mechanism 200. The deadlocking lever 216 has a notch 216*b* that engages end of the rod 202. This prevents the rods from movement due to external forces such as prying pin 206 from below.

The placement of deadlocking levers 216 in the center case mechanism 200 allows the center case mechanism to replace the deadlocking levers that are usually present in the prior art at the bottom of the door frame, resulting in a simpler, cheaper door frame which is more easily ADA approved and more visually appealing.

Figure 14A:
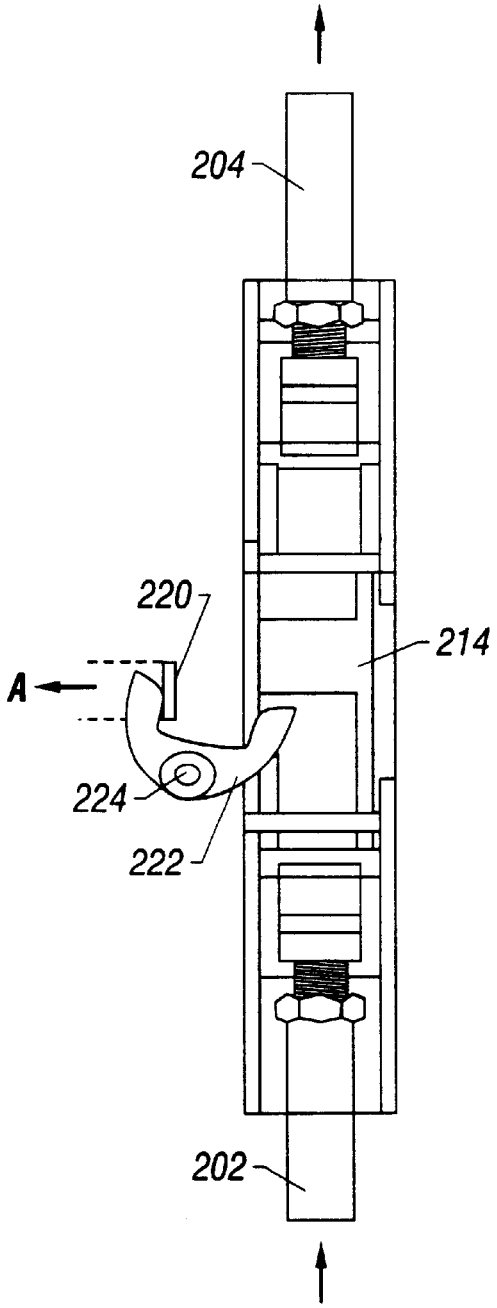
Figure 14B:
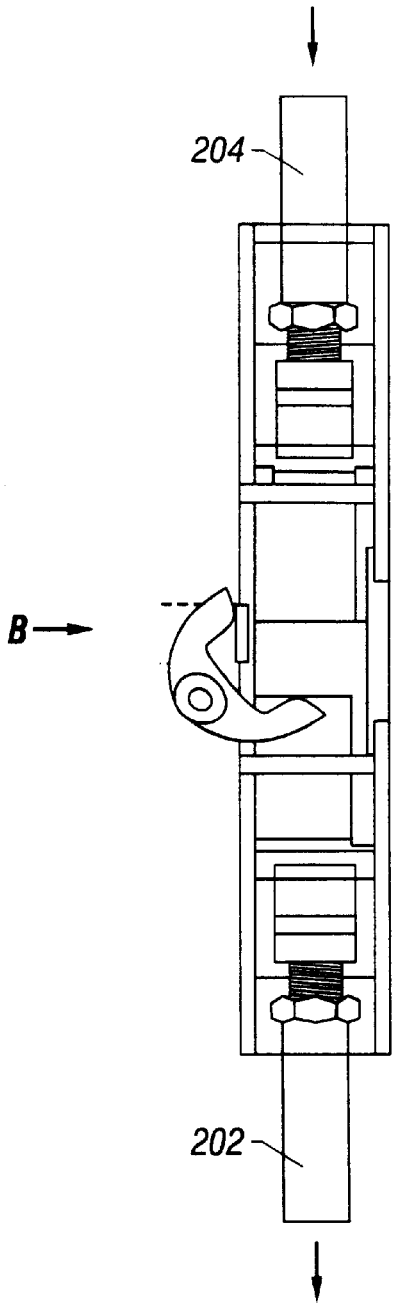

FIGS. 14*a* and 14*b* illustrate the transfer of movement from horizontal to vertical of the rods 202, 204. First linkage

220 as previously described in association with FIGS. 12 and 13, is operatively coupled to coupling cam 222 and when moved in the direction A causes coupling cam 222 to rotate about pin 224. The rotation of coupling Cam 222 in turn forces the pair of lifting mechanisms 214 to be raised. Similarly, as shown in FIG. 14*b,* as first linkage 220 is moved in direction B, coupling Cam 222 rotates about pin 224 in the opposite direction allowing lifting mechanism 214 to lower rods 204 and 202.

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of steps without departing from the spirit of the invention. Accordingly, the present invention is intended to encompass such rearrangements, modifications, and substitutions of steps as fall within the scope of the appended claims.

We claim the following invention:

1. A mounting plate for mounting a panic exit device on a door, comprising:

a base having at least one mounting hole;

at least one flange extending from said base; and, at least one slot located on said flange, said slot being engagable with a tab on a strike locator.

2. The mounting plate of claim 1, wherein at least one slot is engagable with a tab on said panic exit device.

3. The mounting plate of claim 1, wherein at least two flanges extend from said base in substantially parallel orientation.

4. The mounting plate of claim 1, wherein said panic exit device may be supportably positioned by engagement with said slot of said mounting plate.

5. The mounting plate of claim 1, wherein the mounting plate is reversible for use with either a left-handed or right-handed door.

6. The mounting plate of claim 1, wherein the mounting plate is attachable to either a rim mounted panic exit device or a surface vertical rod panic exit device.

7. A mounting plate for mounting a panic exit device on a door, comprising:

a base having at least one mounting hole;

a cam rotatably mounted to said base for engaging a release mechanism on said panic exit device.

8. The mounting plate of claim 7, said cam further comprising:

an aperture for engagement of a shaft of a locking device.

9. The mounting plate of claim 8, wherein the aperture is substantially cruciform.

10. The mounting plate of claim 7, further comprising:

a cam limiter tab extending upward from said base.

11. The mounting plate of claim 7, further comprising:

a cam limiter tab extending outward from said base and being engagable with a relief on a strike locating device.

12. A strike locating device for positioning a mounting plate of a panic exit device, comprising:

a first side having a strike locating means;

a second side substantially perpendicular to said first side; and, said second side being engagable with a mounting plate of a panic exit device.

13. The strike locating device of claim 12, wherein said strike locating means further comprises:

a plurality of strike locating holes.

14. The strike locating device of claim 12, wherein said strike locating means further comprises:

an alignment mark substantially centered on said first side.

15. The strike locating device of claim 12, wherein said second side further comprises:

at least one tab engagable with a slot on said mounting plate of said panic exit device.

16. The strike locating device of claim 12, further comprising:

at least one tab extending above said second side for overlapping engagement with said base of said mounting plate.

17. The strike locating device of claim 12, wherein said second side further comprises:

a plurality of mullion locating holes.

18. The strike locating device of claim 12, wherein said strike locating device is made of a substantially transparent material.

19. The strike locating device of claim 12, the second side further comprising;

a centralized relief.

20. The strike locating device of claim 19, wherein said relief is engagable with a tab on said mounting plate of said panic exit device.

21. A panic exit device attachable to a mounting plate, comprising:

a housing having at least one leg receivable in a channel formed by flanges on said mounting plate; and, at least one tab attached to said leg, said tab being engageable with a slot on one said flange.

22. A method of mounting a panic exit device on a door, comprising:

positioning a strike locator on said door;

coupling a mounting plate to said strike locator;

attaching said mounting plate to said door; and, coupling said panic exit device to said mounting plate.

23. A panic exit device assembly, comprising:

a mounting plate having;

a base having at least one mounting hole;

a flange extending from said base;

a slot located on said flange; and, a latching mechanism having a tab engaged with said slot.

24. A mounting plate for mounting a panic exit device on a door, comprising;

a base;

a pair of outside flanges extending from said base;

a slot located in at least one of said outside flanges; and, a pair of inside flanges extending from said base.

25. The mounting plate of claim 24, further comprising:

a channel formed between said outside flanges and said inside flanges, said channel sized to receive a vertical housing of a panic exit device.

* * * * *